US011505841B2

(12) United States Patent
Tast et al.

(10) Patent No.: US 11,505,841 B2
(45) Date of Patent: Nov. 22, 2022

(54) HIGH-STRENGTH STEEL PRODUCT AND METHOD OF MANUFACTURING THE SAME

(71) Applicant: SSAB TECHNOLOGY AB, Stockholm (SE)

(72) Inventors: Jouni Tast, Sievi (FI); Teppo Pikkarainen, Mustasaari (FI); Tommi Liimatainen, Raahe (FI); Kati Rytinki, Raahe (FI)

(73) Assignee: SSAB TECHNOLOGY AB, Stockholm (SE)

( * ) Notice: Subject to any disclaimer, the term of this patent is extended or adjusted under 35 U.S.C. 154(b) by 0 days.

(21) Appl. No.: 17/299,050

(22) PCT Filed: Dec. 11, 2019

(86) PCT No.: PCT/EP2019/084620
§ 371 (c)(1),
(2) Date: Jun. 2, 2021

(87) PCT Pub. No.: WO2020/120563
PCT Pub. Date: Jun. 18, 2020

(65) Prior Publication Data

US 2022/0106654 A1 Apr. 7, 2022

(30) Foreign Application Priority Data

Dec. 11, 2018 (EP) ..... 18211616

(51) Int. Cl.
*C21D 8/02* (2006.01)
*C21D 6/00* (2006.01)
(Continued)

(52) U.S. Cl.
CPC ..... *C21D 8/0226* (2013.01); *C21D 6/004* (2013.01); *C21D 6/005* (2013.01); *C21D 6/008* (2013.01);
(Continued)

(58) Field of Classification Search
CPC ..... C21D 8/0226; C21D 6/005; C21D 6/006; C21D 6/008; C21D 6/0263;
(Continued)

(56) References Cited

U.S. PATENT DOCUMENTS 8,647,564 B2 2/2014 Ahn et al.
2010/0074794 A1 3/2010 Ahn et al.
(Continued)

FOREIGN PATENT DOCUMENTS

CN 101535518 A 9/2009
CN 101883875 A 11/2010
(Continued)

OTHER PUBLICATIONS

International Search Report and Written Opinion dated Mar. 12, 2020 by the International Searching Authority for International Application No. PCT/EP2019/084620, filed on Dec. 11, 2019 and published as WO 2020/120563 on Jun. 18, 2020 (Applicant—SSAB Technology AB) (8 Pages).

*Primary Examiner* — Humera N. Sheikh
*Assistant Examiner* — Katherine A Christy
(74) *Attorney, Agent, or Firm* — Ballard Spahr LLP

(57) ABSTRACT

A high-strength steel product is described that includes a composition consisting of, in terms of weight percentages, 0.02% to 0.05% C, 0.1% to 0.6% Si, 1.1% to 2.0% Mn, 0.01% to 0.15% Al, 0.01% to 0.08% Nb, 0.5% or less Cu, 0.5% or less Cr, 0.7% or less Ni, 0.03% or less Ti, 0.1% or less Mo, 0.1% or less V, 0.0005% or less B, 0.015% or less P, 0.005% or less S, and the remainder being Fe and inevitable impurities, wherein the steel product has a microstructure comprising a matrix consisting of, in terms of volume percentages, 40% to 80% quasi-polygonal ferrite, 20% to 40% polygonal ferrite, 20% or less bainite, and the remainder being pearlite and martensite of 20% or less.

16 Claims, 12 Drawing Sheets

(51) Int. Cl.

| | |
|---|---|
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.
CPC ..... *C21D 8/0263* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/002* (2013.01); *C21D 2211/005* (2013.01); *C21D 2211/008* (2013.01); *C21D 2211/009* (2013.01)

(58) Field of Classification Search
CPC ..... C21D 2211/002; C21D 2211/005; C21D 2211/008; C21D 2211/009; C22C 38/02; C22C 38/06; C22C 38/42; C22C 38/44; C22C 38/46; C22C 38/48; C22C 38/50; C22C 38/58
USPC ..... 428/544
See application file for complete search history.

(56) References Cited

U.S. PATENT DOCUMENTS

| | | | | |
|---|---|---|---|---|
| 2015/0203933 | A1* | 7/2015 | Toyoda ..... | B23K 11/0873 138/171 |
| 2018/0363107 | A1 | 12/2018 | Lee et al. | |

FOREIGN PATENT DOCUMENTS

| | | | |
|---|---|---|---|
| CN | 108291287 | A | 7/2018 |
| CN | 108368587 | A | 8/2018 |
| EP | 2 295 615 | | 3/2011 |
| EP | 2 484 792 | | 8/2012 |
| EP | 2735622 | B1 | 5/2014 |
| EP | 2 837 708 | | 2/2015 |
| EP | 2 868 765 | | 5/2015 |
| EP | 3 225 709 | | 10/2017 |
| WO | WO 2013/011791 | A1 | 1/2013 |

* cited by examiner

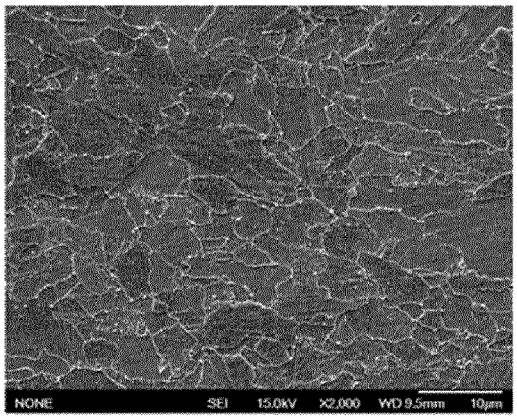
FIG. 12A
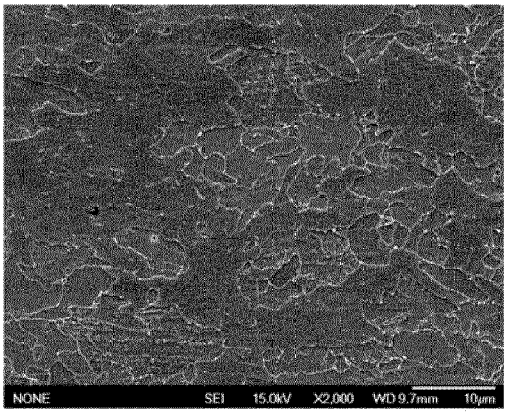
FIG. 12B - Prior Art
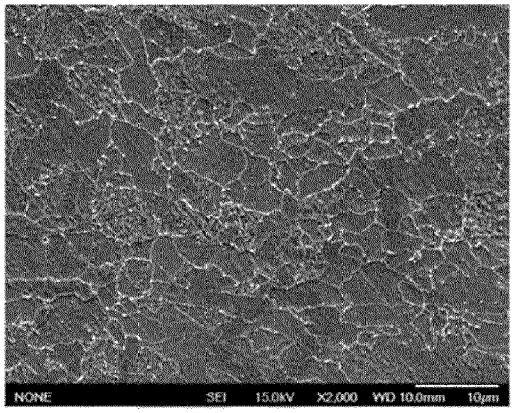
FIG. 12C - Prior Art

HIGH-STRENGTH STEEL PRODUCT AND METHOD OF MANUFACTURING THE SAME

CROSS-REFERENCE TO RELATED APPLICATIONS

This application is a U.S. National Phase Application of International Application No. PCT/EP2019/084620, filed Dec. 11, 2019, which claims priority to European Application No. 18211616.0, filed Dec. 11, 2018, each of which are hereby incorporated by reference in their entirety.

FIELD OF INVENTION

The present invention relates to a high-strength ultralow carbon steel product that can be used for making pressure vessels, gas transmission pipelines and construction materials. The present invention further relates to a method for manufacturing the high-strength ultralow carbon steel product.

BACKGROUND

A general trend in steel development is towards higher strength and low-temperature impact toughness combined with good weldability. Conventional and standard heavy plate pressure vessel steels, e.g. ASTM A537 CL2, have been traditionally produced with a carbon level of 0.1 to 0.2 percent by weight (wt. %) to obtain sufficient strength level. Due to the high carbon content these steels have deteriorated weldability, poor toughness and low resistance to hydrogen induced cracking (HIC). Therefore, it is necessary to reduce the carbon content of steel in demand for good formability, low carbon equivalent (CE), low impact transition temperature, good crack tip opening displacement (CTOD) properties and high resistance to post weld heat treatment (PWHT).

Low carbon (C) steels has been developed in which C is not the major source of strength since high C concentrations may bring about poor weldability and weld toughness. Further, high C concentrations may impair the impact toughness of steel. One of the first investigations with very low carbon steels was by McEvily et al. from Ford Motor Company in 1967. They showed that 0.04C-3.0Ni-3.0Mo-0.05Nb would give the yield strength around 700 MPa together with a transition temperature of about −75° C. However, this composition was highly alloyed and more economic alloying elements giving equivalent properties were sought.

In order to compensate the loss of strength due to low C content, the alloy design philosophy has been based on the advanced use of cost effective microalloying elements, such as niobium (Nb), titanium (Ti), vanadium (V) and boron (B) in conjunction with moderate levels of other alloying elements, such as manganese (Mn), silicon (Si), chromium (Cr), molybdenum (Mo) and copper (Cu) to improve austenite hardenability. The sophisticated use of aforementioned combinations of (micro)alloying elements in conjunction with low C content can lead to steels with yield strength ranging from 500 MPa to 900 MPa. These (micro) alloying elements contribute to the increase in strength via microstructural refinement, precipitation hardening and solid solution strengthening as well as strengthening through microstructural modification.

Generally, low carbon microalloyed steels are processed via thermomechanically controlled processing (TMCP), which classically consists of three stages. During the first rough rolling stage, austenite grain size is refined due to repeated cycles of the recrystallization process. In the second controlled rolling stage, the austenite is deformed in the non-recrystallization temperature regime, which brings significant refinement to the final ferrite microstructure. In the last stage, accelerated cooling can be applied to further refine the resulting ferrite grain size while suppressing the formation of polygonal ferrite and facilitating the formation of lower-temperature transformation products such as different types of bainite. Thus, these low carbon microalloyed steels with high strength are often referred as low carbon bainitic (LCB) steels. The combination of low carbon and ultrafine ferrite grain size provides a good combination of strength and toughness, as well as good weldability owing to low carbon and low alloy content.

Combinations of TMCP, and application of (micro)alloying have impacts on the microstructural development which is related with the mechanical properties. In continuously cooled low carbon microalloyed steels, the main austenite decomposition product is ferrite. However, it is also possible that a part of the parent austenite is not transformed and may be retained at room temperature or partially transformed to produce martensite-austenite (MA) microconstituents. At very high cooling rates even very low carbon steels with sufficient hardenability may transform into martensite.

Microstructures of the LCB steels are often complex, consisting of mixtures of different ferrite morphologies ranging from polygonal ferrite to lath-like martensite. The classification system and terminology proposed by Bainite Committee of Iron and Steel Institute of Japan (ISIJ) is useful in characterizing all possible ferrite morphologies formed in low C steels. The short descriptions of all the six ferrite morphologies are as follows.

1. Polygonal ferrite (PF) exhibits roughly equiaxed grains with smooth boundaries.
2. Quasi-polygonal ferrite (QF) exhibits grains with undulating boundaries, which may cross prior austenite boundaries containing a dislocation sub-structure and occasional MA microconstituents. This is also referred to as massive ferrite.
3. Widmanstätten ferrite (WF) exhibits elongated crystals of ferrite with a minimal dislocation substructure.
4. Granular bainte (GB) exhibits sheaves of elongated ferrite crystals (granular or equiaxed shapes) with low disorientations and a high dislocation density, containing roughly equiaxed islands of MA constituents.
5. Bainitic ferrite (BF), a.k.a. acicular ferrite (AF), exhibits packets of parallel ferrite laths or plates separated by low-angle boundaries and containing very high dislocation densities. MA constituents retained between the ferrite crystals have an acicular morphology.
6. Dislocated cubic martensite exhibits highly dislocated lath like morphology, conserving prior austenite boundaries.

EP 2484792 A1 relates to low carbon steels having a three-phase microstructure consisting of, in terms of area fraction, 5% to 70% bainite, 3% to 20% MA constituent and the remainder being quasi-polygonal ferrite. The area fraction of quasi-polygonal ferrite is preferably 10% or more to ensure the strength. The 5% to 70% bainite ensures the toughness of the base material. The 3% to 20% MA constituent ensures the low yield ratio as well as the toughness of the base material. The three-phase microstructure excludes the presence of polygonal ferrite or other microstructures. The low carbon steels have low yield ratio, high strength, high toughness and excellent strain ageing resistance. The low carbon steels are produced by a method comprising the steps of heating to a temperature in the range of 1000° C. to 1300° C.; hot rolling with a final rolling temperature not lower than Ar3 transformation temperature, wherein the accumulative rolling reduction in the austenite non-recrystallization temperature range is 50% or more; accelerated cooling to a stop temperature of 500° C. to 680° C.; and reheating to a temperature of 550° C. to 750° C.

EP 2380997 A1 describes low carbon steels for weld construction having excellent high-temperature strength and low-temperature toughness, and suppressed weld cracking parameter. The high-temperature strength is secured by a co-addition of Cr and Nb which contributes to transformation strengthening and precipitation strengthening. The low carbon steels comprising bainitic structures are produced by a method comprising the steps of heating to a temperature in the range of 1000° C. to 1300° C., preferably 1050° C. to 1250° C.; hot rolling with a final rolling temperature of 800° C. or more, preferably 800° C. or more; and accelerated cooling to a stop temperature of 550° C. or less, preferably 520° C. to 300° C.

JP 2007119861 (A) or JP 2007277679 (A) also relates to low carbon steels for welding structure having excellent high-temperature strength and low-temperature toughness, and suppressed weld cracking parameter. The low carbon steels comprising martensite-austenite mixed phase (i.e. MA constituents) are produced by a method comprising the steps of heating to a temperature in the range of 1000° C. to 1300° C.; hot rolling with a final rolling temperature of 750° C. or more, wherein the accumulative rolling reduction in the austenite non-recrystallization temperature range is 30% or more; and accelerated cooling to a stop temperature of 350° C. or less. It was noticed in the description that when the accelerated cooling was stopped at a temperature of 230° C., the hardness difference between the surface and the center of a steel plate with a thickness of 50 mm became extremely large such that bendability and hole expandability would be adversely affected.

KR 20030054424 (A) relates to non-heat treated low carbon steels with high weldability, high toughness and high tensile strength of greater than 600 MPa. It was found that formation of polygonal ferrite in the austenite grain boundary needs to be prevented to secure the strength. In order to achieve excellent toughness it is necessary to regulate the accumulative rolling reduction within the range of 30% to 60% in the austenite non-recrystallization temperature zone. If the accumulative rolling reduction in the austenite non-recrystallization temperature range is less than 30%, it is not be effective in increasing low-temperature toughness. If the accumulative rolling reduction in the austenite non-recrystallization temperature range is excessively increased and exceeds 60%, the effect of reducing the transition temperature is saturated whereas anisotropy is increased such that plate distortion problems would occur during use.

The present invention aims at further developing the high strength low carbon steel and the manufacturing method thereof such that a new steel product with uncompromised mechanical properties as well as economic advantages can be achieved.

SUMMARY OF INVENTION

In view of the state of art, the object of the present invention is to solve the problem of providing high strength low carbon steels excellent in low-temperature impact toughness, bendability/formability and weldability which are required in the applications of e.g. fusion welded pressure vessels and structures. The problem is solved by the combination of cost-efficient (micro)alloy designs with cost-efficient TMCP procedures which produces a metallographic microstructure comprising mainly quasi-polygonal ferrite.

In a first aspect, the present invention provides a high-strength steel product comprising a composition consisting of, in terms of weight percentages (wt. %):

C 0.02-0.05, preferably 0.03-0.045
Si 0.1-0.6, preferably 0.2-0.6, more preferably 0.3-0.5
Mn 1.1-2.0, preferably 1.35-1.8
Al 0.01-0.15, preferably 0.02-0.06
Nb 0.01-0.08, preferably 0.025-0.05
Cu ≤0.5, preferably 0.15-0.35
Cr ≤0.5, preferably 0.1-0.25
Ni ≤0.7, preferably 0.1-0.25
Ti ≤0.03, preferably 0.005-0.03
Mo ≤0.1
V ≤0.1, preferably ≤0.05
B ≤0.0005
P ≤0.015, preferably ≤0.012
S ≤0.005 remainder Fe and inevitable impurities.

The steel product is low-alloyed with cost-efficient alloying elements such as C, Si, Mn, Al and Nb. Other elements such as Cu, Cr, Ni, Ti, Mo, V and B may be present as residual contents that are not purposefully added. The difference between residual contents and unavoidable impurities is that residual contents are controlled quantities of alloying elements, which are not considered to be impurities. A residual content as normally controlled by an industrial process does not have an essential effect upon the alloy.

Preferably, the steel product comprises non-metallic inclusions having an average inclusion size in the range of 1 μm to 4 μm in diameter, and wherein 95% of the inclusions are less than 4 μm in diameter.

In a second aspect, the present invention provides a method for manufacturing the high-strength steel product comprising the following steps of

- heating a steel slab with the composition according to claim 1 to a temperature in the range of 950° C. to 1350° C.;
- hot rolling the heated steel slab in a plurality of hot rolling passes, wherein
  - i. the steel slab is subjected to a first plurality of rolling passes at a temperature above the austenite non-recrystallization temperature,
  - ii. the steel slab from step (i) is cooled down to a temperature below the austenite non-recrystallization temperature,
  - iii. the steel slab from step (ii) is subjected to a second plurality of controlled rolling passes at a temperature below the austenite non-recrystallization temperature, wherein the reduction ratio of the controlled rolling passes is at least 1.5, preferably 2.0, more preferably 2.5, and wherein the final rolling temperature is in the range of 800° C. to 880° C.;
- accelerated continuous cooling to a temperature below 230° C. at a cooling rate of at least 5° C./s.

The controlled rolling passes at a temperature below the austenite non-recrystallization temperature $T_{nr}$ causes an accumulation of austenite deformation which results in the formation of elongated grains and deformation bands. The grain boundaries and deformation bands may act as nucleation sites for the austenite to ferrite (γ-α) transformation. The grain boundaries are also getting closer to each other due to the austenite grain elongation, thereby increasing the nucleation density. In combination with the high nucleation rate caused by the accelerated continuous cooling, the process finally leads to an ultrafine ferrite grain size.

After the accelerated continuous cooling, it is optional to perform an extra step of tempering at a temperature in the range of 580° C. to 650° C. for 0.5 hour to 1 hour. The extra step of tempering may optionally be induction tempering at a temperature typically in the range of 580° C. to 700° C. for 1 minute to 60 minutes.

Preferably, the accumulative reduction ratio of hot rolling is in the range of 4.0 to 35.

The processing parameters must be strictly controlled for improvement of mechanical properties and in particular toughness, where the major parameters involved are the heating temperature, the accumulative reduction ratio of the controlled rolling passes below the austenite non-recrystallization temperature, the final rolling temperature and the accelerated continuous cooling stop temperature.

The steel product is a strip or plate having a thickness of 6 to 65 mm, preferably 10 to 45 mm.

The obtained steel product has a microstructure comprising a matrix consisting of, in terms of volume percentages (vol. %):

quasi-polygonal ferrite 40-80 polygonal ferrite and bainite 20-60 pearlite and martensite ≤20, preferably ≤5, more preferably ≤2

Preferably, the microstructure comprises polygonal ferrite in an amount of 20 vol. % to 40 vol. %.

Preferably, the microstructure comprises bainite in an amount of 20 vol. % or less.

A good combination of strength and toughness was associated with the quasi-polygonal ferrite based microstructure. The steel product has the following mechanical properties: an yield strength of at least 400 MPa, preferably at least 415 MPa, more preferably in the range of 415 MPa to 650 MPa; an ultimate tensile strength of at least 500 MPa, preferably in the range of 500 MPa to 690 MPa, more preferably in the range of 550 MPa to 690 MPa;

a Charpy-V impact toughness of at least 34 J/cm$^2$, preferably at least 150 J/cm$^2$, more preferably at least 300 J/cm$^2$ at a temperature in the range of −50° C. to −100° C.

The steel product exhibits excellent bendability or formability. The steel product has a minimum bending radius of 5.0 t or less, preferably 3.0 t or less, more preferably 0.5 tin the longitudinal or transverse direction, and wherein t is the thickness of a steel strip or plate.

Consequently, improvement in the properties such as low-temperature impact toughness, bendability/formability and weldability, as well as HIC- and PWHT-resistance can be achieved. A post weld heat treatment at a temperature in the range of 500° C. to 680° C. for 1 hour to 8 hours, or at a temperature in the range of 600° C. to 640° C. for 4 hours to 8 hours, has little or no negative effect on the steel product.

BRIEF DESCRIPTION OF DRAWINGS

FIG. 12 illustrates the microstructures of tested samples.

DETAILED DESCRIPTION OF THE INVENTION

Figure 1:
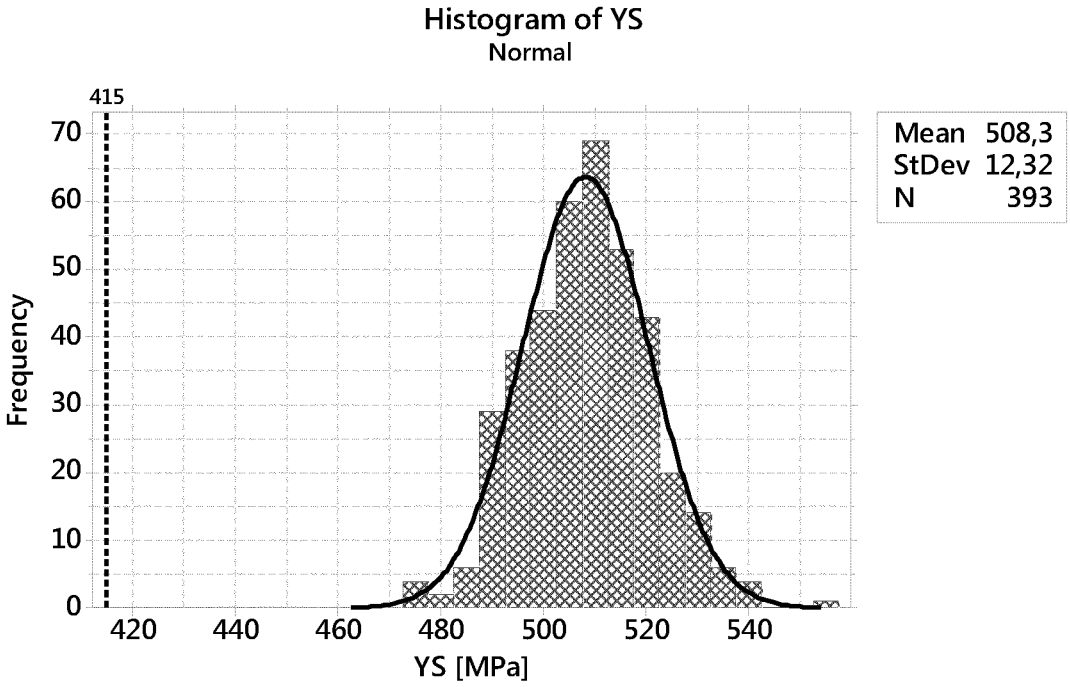
FIG. 1 is a graph showing the yield strength (YS) of a produced batch of 2000 ton of plates.

The term "steel" is defined as an iron alloy containing carbon (C).

The term "(micro)alloying elements" is used to refer to

- microalloying elements (MAE), such as niobium (Nb), titanium (Ti), vanadium (V) and boron (B); and/or
- alloying elements in moderate levels, such as manganese (Mn), silicon (Si), chromium (Cr), molybdenum (Mo) and copper (Cu).

The term "non-metallic inclusions" refers to product of chemical reactions, physical effects, and contamination that occurs during the manufacturing process. Non-metallic inclusions include oxides, sulfides, nitrides, silicates and phosphides.

The term "austenite non-recrystallization temperature" ($T_{nr}$) is defined as the temperature below which no complete static recrystallization of austenite occurs between the rolling passes.

The term "controlled rolling (CR)" refers to the hot rolling at temperatures below the austenite non-recrystallization temperature ($T_{nr}$).

The term "reduction ratio" refers to the ratio of thickness reduction obtained by a rolling process. A reduction ratio is calculated by dividing the thickness before the rolling process with the thickness after the rolling process. A reduction ratio of 2.5 corresponds to 60% of reduction in thickness.

The term "controlled rolling ratio" refers to the reduction ratio obtained by controlled rolling at temperatures below $T_{nr}$.

The term "accumulative reduction ratio" refers to the total reduction ratio obtained by hot rolling at temperatures above and below $T_{nr}$.

The term "accelerated continuous cooling (ACC)" refers to a process of accelerated cooling at a cooling rate down to a temperature without interruption.

The term "interrupted accelerated cooling (IAC)" refers to a process of accelerated cooling at a cooling rate within a temperature range followed by air cooling down to a temperature below the temperature range.

The term "ductile to brittle transition temperature (DBTT)" is defined as the minimum temperature in which steel has the ability to absorb a specific amount of energy without fracturing. At temperatures above the DBTT, the steel can bend or deform like plastic upon impact; whereas at temperatures below the DBTT, the steel has a much greater tendency to fracture or shatter upon impact.

The term "ultimate tensile strength (UTS, Rm)" refers to the limit, at which the steel fractures under tension, thus the maximum tensile stress.

The term "yield strength (YS, $Rp_{0.2}$)" refers to 0.2% offset yield strength defined as the amount of stress that will result in a plastic strain of 0.2%.

The term "total elongation (TEL)" refers to the percentage by which the material can be stretched before it breaks; a rough indicator of formability, usually expressed as a percentage over a fixed gauge length of the measuring extensometer. Two common gauge lengths are 50 mm ($A_{50}$) and 80 mm ($A_{80}$).

The term "minimum bending radius (Ri)" is used to refer to the minimum radius of bending that can be applied to a test sheet without occurrence of cracks.

The term "bendability" refers to the ratio of Ri and the sheet thickness (t).

The symbol "KV" refers to the absorbed energy required to break a V-notched test piece of defined shape and dimensions when tested with a pendulum impact testing machine.

The alloying content of steel together with the processing parameters determines the microstructure which in turn determines the mechanical properties of the steel.

Alloy design is one of the first issues to be considered when developing a steel product with targeted mechanical properties. Generally, it can be stated that the lower the C content and the higher target strength level, the higher the amount of substitutional (micro)alloying elements is required, in order to obtain equivalent strength levels.

Next the chemical composition is described in more details, wherein % of each component refers to weight percentage.

Carbon C is Used in the Range of 0.02% to 0.05%.

C alloying increases strength of steel by solid solution strengthening, and hence C content determines the strength level. C content less than 0.02% may lead to insufficient strength. However, C has detrimental effects on weldability, weld toughness and impact toughness of steel. C also raises DBTT. Therefore, C content is set to not more than 0.05%.

Preferably, C is used in the range of 0.03% to 0.045%.

Silicon Si is Used in the Range of 0.1% to 0.6%.

Si is effective as a deoxidizing or killing agent that can remove oxygen from the melt during a steelmaking process. Si alloying enhances strength by solid solution strengthening, and enhances hardness by increasing austenite hardenability. Also the presence of Si can stabilize residual austenite. However, silicon content of higher than 0.6% may unnecessarily increase carbon equivalent (CE) value thereby weakening the weldability. Furthermore, surface quality may be deteriorated if Si is present in excess.

Preferably, Si is used in the range of 0.2% to 0.6%, and more preferably 0.3% to 0.5%.

Manganese Mn is Used in the Range of 1.1% to 2.0%.

Mn is an essential element improving the balance between strength and low-temperature toughness. There seems to be a rough relation between higher Mn content and higher strength level. Mn alloying enhances strength by solid solution strengthening, and enhances hardness by increasing austenite hardenability. However, alloying with Mn more than 2.0% unnecessarily increases the CE value thereby weakening the weldability. If the Mn content is too high, hardenability of the steel increases such that not only the heat-affect zone (HAZ) toughness is deteriorated, but also centerline segregation of the steel plate is promoted and consequently the low-temperature toughness of the center of the steel plate is impaired.

Preferably, Mn is used in the range of 1.35% to 1.8%.

Aluminum Al is Used in the Range of 0.01% to 0.15%.

Al is effective as a deoxidizing or killing agent that can remove oxygen from the melt during a steelmaking process. Al also removes N by forming stable AlN particles and provides grain refinement, which effects promote high toughness, especially at low temperatures. Also Al stabilizes residual austenite. However, excess Al may increase non-metallic inclusions thereby deteriorating cleanliness.

Preferably, Al is used in the range of 0.02% to 0.06%.

Niobium Nb is Used in the Range of 0.01% to 0.08%.

Nb forms carbides NbC and carbonitrides Nb(C,N). Nb is considered to be a major grain refining element. Nb contributes to the strengthening and toughening of steels in four ways:

i. refining the austenite grain structure due to the pinning effect of Nb(C,N) during the reheating and soaking stage at high temperatures by introducing fine Nb(C, N) precipitates;
ii. retarding the recrystallization kinetics due to Nb solute drag effect at high temperatures (>1000° C.) and preventing the occurrence of recrystallization due to strain induced precipitation at lower temperatures and thereby contributing to microstructural refinement;
iii. precipitation strengthening during and/or after y-a transformation (or subsequent heat treatment); and
iv. retarding the phase transformation to lower temperatures giving rise to transformation hardening and toughening.

Nb is an preferred alloying element in these steels, since it promotes formation of quasi-polygonal ferrite/granular bainite microstructure instead of polygonal ferrite formation. Yet, Nb addition should be limited to 0.08% since further increase in Nb content does not have a pronounced effect on further increasing the strength and toughness. Nb can be harmful for HAZ toughness since Nb may promote the formation of coarse upper bainite structure by forming relatively unstable TiNbN or TiNb(C,N) precipitates.

Preferably, Nb is used in the range of 0.025% to 0.05%.

Copper Cu is Used in the Range of 0.5% or Less.

Cu can promote low carbon bainitic structures, cause solid solution strengthening and contribute to precipitation strengthening. Cu has also beneficial effects against HIC and sulfide stress corrosion cracking (SSCC). When added in excessive amounts, Cu deteriorates field weldability and the HAZ toughness. Therefore, its upper limit is set to 0.5%.

Preferably, Cu is used in the range of 0.15% to 0.35%.

Chromium Cr is Used in the Range of 0.5% or Less.

As mid-strength carbide forming element Cr increases the strength of both the base steel and weld with marginal expense of impact toughness. Cr alloying enhances strength and hardness by increasing austenite hardenability. However, if Cr is used in content above content 0.5% the HAZ toughness as well as field weldability may be adversely affected.

Preferably, Cr is used in the range of 0.1% to 0.25%.

Nickel Ni is Used in the Range of 0.7% or Less.

Ni is an alloying element that improves austenite hardenability thereby increasing strength without any loss of toughness and/or HAZ toughness. However nickel contents of above 0.7% would increase alloying costs too much without significant technical improvement. Excess Ni may produce high viscosity iron oxide scales which deteriorate surface quality of the steel product. Higher Ni content also has negative impacts on weldability due to increased CE value and cracking sensitivity coefficient.

Preferably, Ni is used in the range of 0.1% to 0.25%.

Titanium Ti is Used in the Range of 0.03% or Less.

Ti is added to bind free N that is harmful to toughness by forming stable TiN together with NbC can efficiently prevent austenite grain growth in the reheating stage at high temperatures. TiN precipitates can further prevent grain coarsening in HAZ during welding thereby improving toughness. TiN formation suppresses the formation of $Fe_{23}C_6$, thereby stimulating the nucleation of polygonal ferrite. TiN formation also suppresses BN precipitation, thereby leaving B free to make its contribution to hardenability. For this purpose, the ratio of Ti/N is at least 3.4. However, if Ti content is too high, coarsening of TiN and precipitation hardening due to TiC develop and the low-temperature toughness may be deteriorated. Therefore, it is necessary to restrict titanium so that it is less than 0.03%, preferably less than 0.02%.

Preferably, Ti is used in the range of 0.005% to 0.03%.

Molybdenum Mo is Used in a Content of 0.1% or Less.

Mo has effects of promoting low carbon bainitic structure while suppressing polygonal ferrite formation. Mo alloying improves low-temperature toughness and tempering resistance. The presence of Mo also enhances strength and hardness by increasing austenite hardenability. In the case of B alloying, Mo is usually required to ensure the effectiveness of B. However, Mo is not an economically acceptable alloying element. If Mo is used in content above 0.1% toughness may be deteriorated thereby increasing risk of brittleness. Excessive amount of Mo may also reduce the effect of B.

Vanadium V is Used in a Content of 0.1% or Less.

V has substantially the same but smaller effects as Nb. V is a strong carbide and nitride former, but V(C,N) can also form and its solubility in austenite is higher than that of Nb or Ti. Thus, V alloying has potential for dispersion and precipitation strengthening, because large quantities of V are dissolved and available for precipitation in ferrite. However, addition of V more than 0.1% has negative effects on weldability and hardenability due to formation polygonal ferrite instead of bainite.

Preferably, V is used in a content of 0.05% or less.

Boron B is Used in a Content of 0.0005% or Less.

B is a well-established microalloying element to suppress formation of diffusional transformation products such as polygonal ferrite, thereby promoting formation of low carbon bainitic structures. Effective B alloying would require the presence of Ti to prevent formation of BN. In the presence of B, Ti content can be lowered to be less than 0.02%, which is very beneficial for low-temperature toughness. However, the low-temperature toughness and HAZ toughness are rapidly deteriorated when the B content exceeds 0.0005%.

Unavoidable impurities may be phosphor P in a content of 0.015% or less, preferably 0.012% or less; and sulfur S in a content of 0.005% or less. Other inevitable impurities may be nitrogen N, hydrogen H, oxygen O and rare earth metals (REM) or the like. Their contents are limited in order to ensure excellent mechanical properties, such as impact toughness.

Clean steel making practice is applied to minimize unavoidable impurities that may appear as non-metallic inclusions. Non-metallic inclusions disrupt the homogeneity of structure, so their influence on the mechanical and other properties can be considerable. During deformation triggered by flatting, forging and/or stamping, non-metallic inclusions can cause cracks and fatigue failure in steel. Thus, the average inclusion size is limited to typically 1 μm to 4 μm, wherein 95% inclusions are under 4 μm in diameter.

The high-strength steel product may be a strip or plate with a typical thickness of 6 to 65 mm, preferably 10 mm to 45 mm.

The parameters of TMCP are regulated for achieving the optimal microstructure with the chemical composition.

In the heating stage the slabs are heated to a discharging temperature in the range of 950° C. to 1350° C., typically 1140° C., which is important for controlling the austenite grain growth. An increase in the heating temperature can cause dissolution and coarsening of microalloy precipitates, which can result in abnormal grain growth.

In the hot rolling stage the slab is hot rolled with a typical pass schedule of 16-18 hot rolling passes, depending on the thickness of the slab and the final product. Preferably, the accumulative reduction ratio is in the range of 4.0 to 35 at the end of the hot rolling stage.

The first hot rolling process is carried out above the austenite non-recrystallization temperature ($T_{nr}$) and then the slab is cooled down below $T_{nr}$ before controlled rolling passes are carried out below $T_{nr}$.

Controlled rolling at a temperature below the austenite non-recrystallization temperature causes the austenite grains to elongate and creates initiation sites for ferrite grains. Pancaked austenite grains are formed thereby accumulating a strain (i.e. dislocation) in austenite grains that can promote ferrite grain refinement by acting as a nucleation site for austenite to ferrite transformation. The controlled rolling ratio of at least 1.5, preferably 2.0, and more preferably 2.5 ensures that austenite grains are sufficiently deformed. The controlled rolling reduction of 2.5 is achieved with 4 to 10 rolling passes, wherein the reduction per pass is approximately 10.25%. The most prominent consequence of deformation in the austenite non-recrystallization region is the improvement in toughness properties. Surprisingly, the inventors found that raising the controlled rolling reduction ratio from 1.8 to 2.5 or more can significantly lower the transition temperature thereby increasing the low-temperature impact toughness.

The final rolling temperature is typically in the range of 800° C. to 880° C. which contributes to the refinement of microstructure.

The hot rolled product is accelerated cooled to a temperature below 230° C., preferably room temperature, at a cooling rate of at least 5° C./s. The ferrite grain refinement is promoted during the fast accelerated cooling from a temperature above the $Ar_3$ to the cooling stop temperature. Low-temperature transformation microstructures such as bainite are also formed during the accelerated cooling step.

Optionally, a subsequent step of heat treatment such as tempering or annealing is performed for fine tuning the microstructure. Preferably, tempering is performed at a temperature in the range of 580° C. to 650° C. for 0.5 hour to 1 hour. The extra step of tempering may optionally be induction tempering at a temperature typically in the range of 580° C. to 700° C. for 1 minute to 60 minutes.

During the accelerated continuous cooling the polygonal ferrite transformation takes place first, followed by the quasi-polygonal ferrite transformation, bainite transformation and martensite transformation consecutively at decreasing temperatures. The final steel product has a mixed microstructure based on quasi-polygonal ferrite. The microstructure comprises, in terms of volume percentages, 40% to 80% quasi-polygonal ferrite; 20% to 60% polygonal ferrite and bainite; and the remainder 20% or less, preferably 5% or less, more preferably 2% or less being pearlite and martensite. Optionally, the microstructure comprises, in terms of volume percentages, 20% to 40% polygonal ferrite. Optionally, the microstructure comprises, in terms of volume percentages, 20% or less bainite. Occasionally, islands of MA constituents can be detected in microstructure.

Good toughness of steels and especially low DBTT is often associated with high density of high angle boundaries that are usually present in the microstructure and are beneficial, because these boundaries act as obstacles for cleavage crack propagation. The quasi-polygonal ferrite dominated microstructures favours the formation of high angle boundaries between the interfaces of quasi-polygonal ferrite and granular bainitic ferrite, while the formation of quasi-polygonal ferrite eliminates prior austenite grain boundaries in the microstructure.

The quasi-polygonal ferrite dominated microstructures also reduce the size and fraction of MA microconstituents, which are considered as favourable nucleation sites for brittle fracture. The distribution of MA constituents is restricted to the granular bainitic ferrite part of the microstructure.

If the cleavage microcrack is initiated in the vicinity of MA microconstituents, the propagation of this microcrack is easily blunted and temporarily halted due to the adjacent high angle boundary. For a microcrack to reach the critical length, beyond which the microcrack can propagate in an unstable manner, more energy is required to connect and link the neighbouring microcracks by e.g. rotation of the short microcracks in a shearing mode. Therefore, the steels with quasi-polygonal ferrite dominated microstructures exhibit improved impact toughness and especially low DBTT.

The steel product has an yield strength of at least 400 MPa, preferably at least 415 MPa, more preferably in the range of 415 MPa to 650 MPa; and an ultimate tensile strength of at least 500 MPa, preferably in the range of 500 MPa to 690 MPa, more preferably in the range of 550 MPa to 690 MPa. The steel product has a Charpy-V impact toughness of at least 34 J/cm$^2$, preferably at least 150 J/cm$^2$, more preferably at least 300 J/cm$^2$ at a temperature in the range of −50° C. to −100° C. The steel product has a minimum bending radius of 5.0 t or less, preferably 3.0 t or less, more preferably 0.5 tin the longitudinal or transverse direction, and wherein t is the thickness of a steel strip or plate.

The improved mechanical properties can be maintained even after the steel product has been subjected to a post weld heat treatment at a temperature in the range of 500° C. to 680° C. for 1 hour to 8 hours, preferably at a temperature in the range of at 600° C. to 640° C. for 4 hours to 8 hours.

The following examples further describe and demonstrate embodiments within the scope of the present invention. The examples are given solely for the purpose of illustration and are not to be construed as limitations of the present invention, as many variations thereof are possible without departing from the scope of the invention.

Example 1

The chemical composition used for producing the tested plate is presented in Table 1.

TABLE 1

Chemical composition (wt. %) of Example 1.

| | C | Si | Mn | Al | Nb | Cu | Cr | Ni | Ti | Mo | V |
|---|---|---|---|---|---|---|---|---|---|---|---|
| Target | 0.035 | 0.4 | 1.55 | 0.03 | 0.03 | 0.25 | 0.2 | 0.15 | 0.015 | 0 | 0 |
| Min. | 0.025 | 0.3 | 1.48 | 0.02 | 0.025 | 0.15 | 0.1 | 0.1 | 0.005 | | |
| Max. | 0.05 | 0.5 | 1.6 | 0.06 | 0.05 | 0.35 | 0.25 | 0.25 | 0.03 | 0.07 | 0.03 |

The tested plate is prepared by a process comprising the steps of heating to a temperature of 1140° C.;

hot rolling, wherein the controlled rolling reduction ratio is 2.5, the final rolling temperature is in the range of 840° C. to 880° C.;

accelerated continuous cooling to about 100° C.; and tempering at about 640° C.

Microstructure

Microstructure can be characterized from SEM micrographs and the volume fraction can be determined using point counting or image analysis method. The microstructure of the tested plate comprises 40% to 80% quasi-polygonal ferrite, 20% to 40% polygonal ferrite, 20% or less bainite, and the remainder being pearlite and martensite.

Yield Strength

Yield strength was determined according ASTM E8 standard using transverse specimens of a produced batch of 2000 ton of plates. The mean value of yield strength ($Rp_{0.2}$) in the transverse direction is 508±12 MPa (FIG. 1).

Tensile Strength

Figure 2:
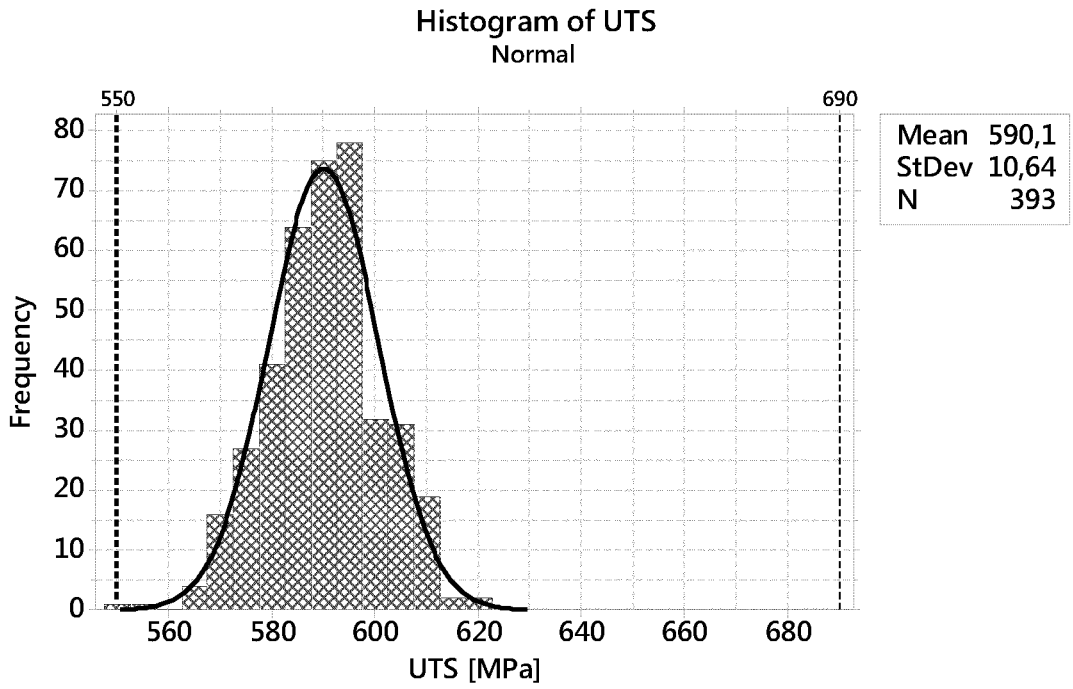
FIG. 2 is a graph showing the ultimate tensile strength (UTS) of a produced batch of 2000 ton of plates.

Tensile strength was determined according ASTM E8 standard using transverse specimens of a produced batch of 2000 ton of plates. The mean value of ultimate tensile strength (Rm) in the transverse direction is 590±1 MPa (FIG. 2).

Elongation

Figure 3:
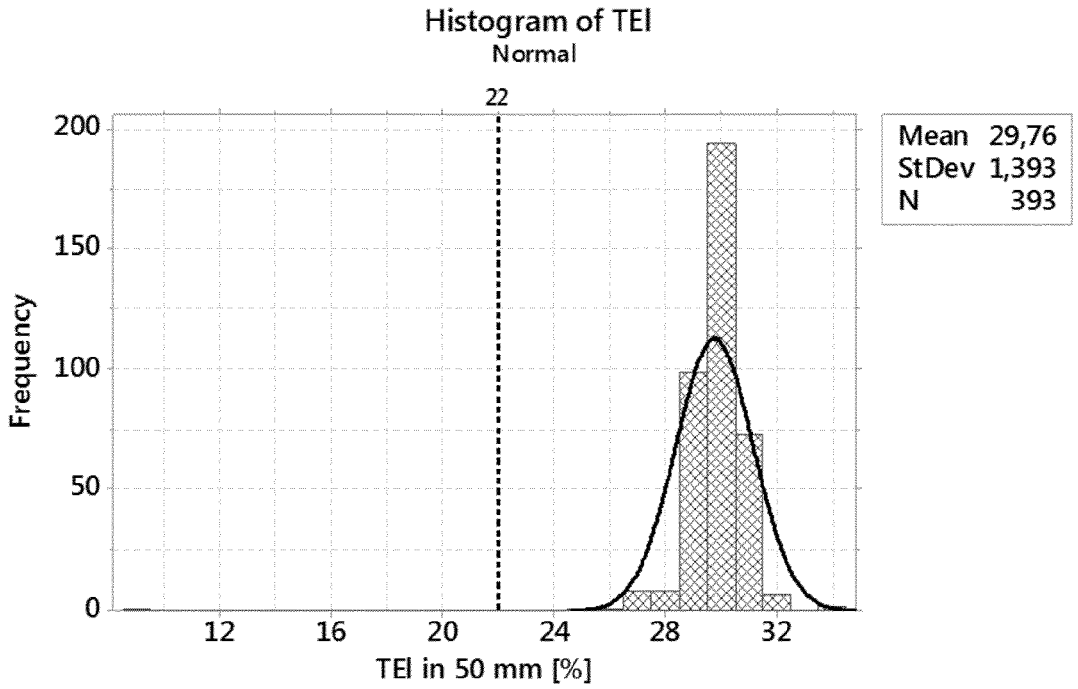
FIG. 3 is a graph showing the total elongation (TEL) of a produced batch of 2000 ton of plates.

Elongation was determined according ASTM E8 standard using transverse specimens of a produced batch of 2000 ton of plates. The mean value of total elongation ($A_{50}$) in the transverse direction is 30±1.4% (FIG. 3).

Bendability

The bend test consists of subjecting a test piece to plastic deformation by three-point bending, with one single stroke, until a specified angle 90° of the bend is reached after unloading. The inspection and assessment of the bends is a continuous process during the whole test series. This is to be able to decide if the punch radius (R) should be increased, maintained or decreased. The limit of bendability (R/t) for a material can be identified in a test series if a minimum of 3 m bending length, without any defects, is fulfilled with the same punch radius (R) both longitudinally and transversally. Cracks, surface necking marks and flat bends (significant necking) are registered as defects.

According to the bend tests, the plate has a minimum bending radius (Ri) 0.5 times plate thickness (t), i.e. Ri=0.5 t, in both longitudinal and transverse directions.

PWHT-Resistance

Excellent tensile properties such as yield strength of at least 415 MPa and ultimate tensile strength of at least 550 MPa are maintained even after severe PWHT-treatments at 620° C. for 8 hours.

Charpy-V Impact Toughness

The impact toughness values at −45° C. were obtained by Charpy V-notch tests according to the ASME (American Society of Mechanical Engineers) Standards.

Figure 4:
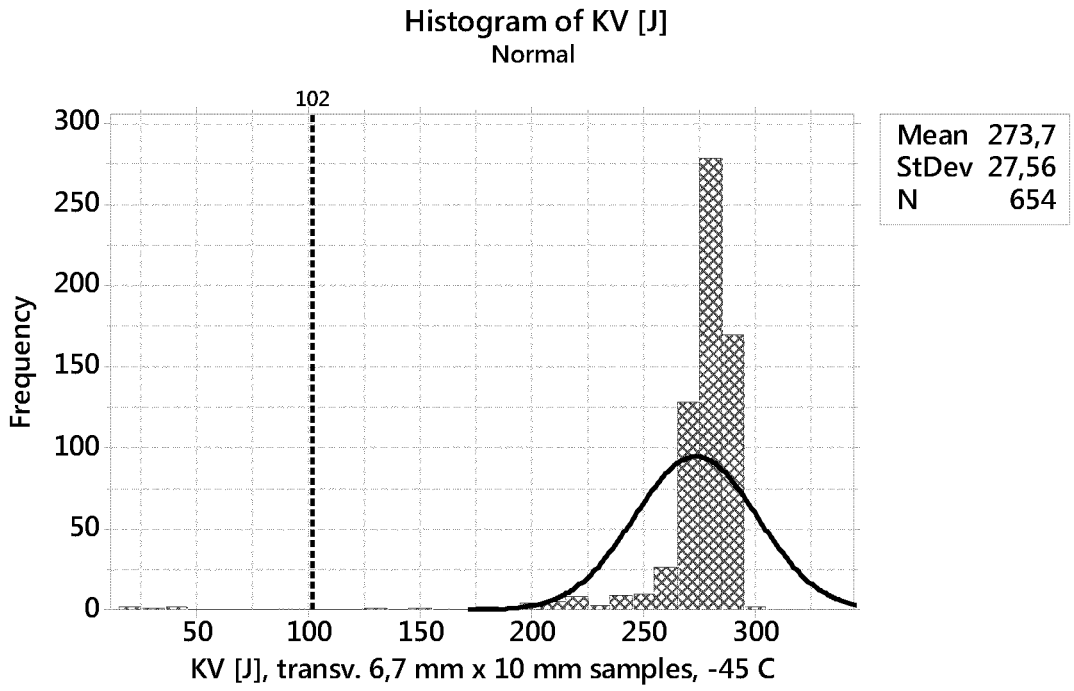
FIG. 4 is a graph showing the impact toughness values at −45° C. (KV) of a produced batch of 2000 ton of plates.

FIG. 4 shows that the mean impact toughness value is 274 J measured using 6.7 mm×10 mm transverse specimens of a produced batch of 2000 ton of plates.

Figure 5:
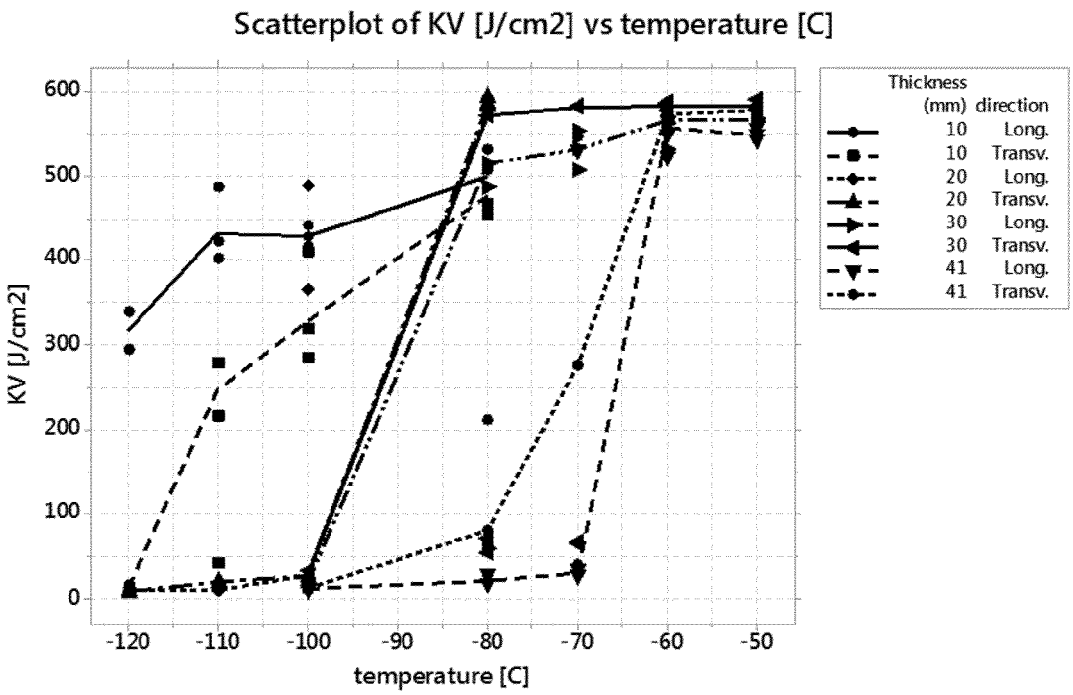
FIG. 5 is a graph showing the Charpy-V impact toughness of plates with different thicknesses.

FIG. 5 shows the Charpy-V impact toughness results of plates with different thicknesses in longitudinal and transverse directions. The Charpy-V impact toughness results of plates with different thicknesses in the transverse direction are summarized in Table 1-1.

TABLE 1-1

Charpy-V impact toughness of plates with different thicknesses

| Thickness (mm) | KV (J/cm2) | Temp. (° C.) | Direction |
|---|---|---|---|
| 10 | 338 | −100 | Tranverse |
| 20 | 587 | −80 | Tranverse |
| 30 | 583 | −60 | Tranverse |
| 41 | 573 | −60 | Tranverse |

In the transverse direction, the test plate with a thickness of 10 mm has an impact toughness of 338 J/cm$^2$ at a temperature of −100° C.; the test plate with a thickness of 20 mm has an impact toughness of 587 J/cm$^2$ at a temperature of −80° C.; the test plate with a thickness of 30 mm has an impact toughness of 583 J/cm$^2$ at a temperature of −60° C.; the test plate with a thickness of 41 mm has an impact toughness of 573 J/cm$^2$ at a temperature of −60° C.

Weldability

Weldability testing was performed on a 41 mm-thick plate. The weldability testing was performed by welding three butt joints using test pieces of 41 mm×200 mm×1000 mm in size. The test pieces were cut from the plate along the principal rolling direction so that the 1000 mm long butt welds were parallel to rolling direction. The joints were welded with flux cored arc welding FCAW process no 136 using heat input of 0.8 kJ/mm and single wire submerged arc welding process no 121 using heat input of 3.5 kJ/mm. Preheating temperature before welding of the plate was in the range of 125° C. and 130° C., and interpass temperature was in the range of 125° C. and 200° C. The butt joints were welded using half V-groove preparation with 25° groove angle. The selected welding consumable for the FCAW process was Esab Filarc PZ6138 having EN/AWS classifications T50-6-1Ni-P-M21-1-H5/E81T1-M21A8-Ni1-H4. The selected welding consumable for the SAW process were Esab OK Autrod 13.27 wire together with Esab OK Flux 10.62 having EN/AWS classifications S-46-7-FB-S2Ni2/F7A10-ENi2-Ni2. Weld which was welded by heat input 3.5 kJ/mm was tested in both as-welded and PWHT conditions. The applied PWHT was performed at a temperature of 600° C. within a holding time of 4 hours.

Table 1-2 presents a summary of the following mechanical testing results of welded joints:

- two transverse tensile tests with rectangular specimens;
- Charpy-V testing of beveled side at −40° C. and −50° C. with three 10 mm×10 mm specimen from locations: fusion line +1 mm (FL+1) and fusion line +5 mm (FL+5); and
- Vickers hardness HV10 cross weld hardness profiles.

The mechanical testing results demonstrate that the steel sample has excellent weldability and excellent HAZ toughness at low temperatures.

HIC-Resistance

Figure 6:
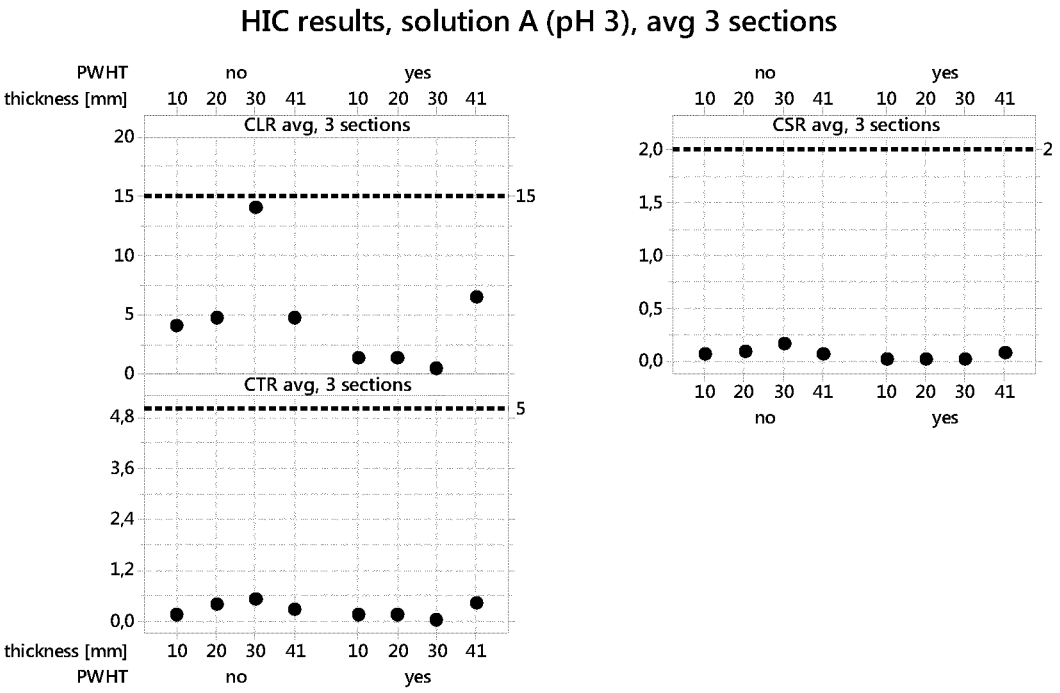
FIG. 6 is a graph showing the NACE TM 0284 HIC-testing results of plates with different thicknesses.

HIC tests were conducted according NACE (National Association of Corrosion Engineers) TM 0284. FIG. 6 shows the NACE TM 0284 HIC-testing results of plates with different thicknesses. The tested plates all exhibit an average (avg.) crack length ratio (CLR) below 15%, which indicates excellent performance of the steel in sour gas environment. The symbol "CSR" refers to crack sensitivity ratio. The symbol "CTR" refers to crack thickness ratio.

Example 2

The chemical compositions used for producing the tested plates are presented in Table 2. The slab number C002 is the comparative example.

The tested plate is prepared by a process as described in Example 1.

The final rolling temperature (FRT) and the accumulative reduction ratio of the controlled rolling (CR) passes below the austenite non-recrystallization temperature are major parameters determining the microstructure and the mechanical properties. A summary of thickness, FRT and CR reduction ratio of the tested plates is presented in Table 2-1. The slab numbers C002-1 and C002-2 are comparative examples.

TABLE 1-2

Weldability results of a 41 mm-thick plate

| Welding energy | | Tensile testing | | | Charpy-V notch impact toughness, average | | | | HAZ max |
|---|---|---|---|---|---|---|---|---|---|
| E [kJ/ | | YS | UTS | Tel in 80 | Notch position, testing temperature | | | | hardness |
| mm] | PWHT | [MPa] | [MPa] | mm [%] | FL + 1, −40 C. | FL + 5, −40 C. | FL + 1, −50 C. | FL + 5, −50 C. | HV 10 |
| 1.0 | no | 525 | 604 | 37 | 177 | 273 | 140 | 281 | 228 |
| 3.5 | no | 471 | 588 | 33 | 255 | 296 | 222 | 280 | 218 |
| 3.5 | 600 C./4 h | 460 | 571 | 34 | 220 | 236 | 225 | 242 | 207 |

TABLE 2

| Chemical composition (wt. %) of the tested plates | | | | | | | | | | | | | | | | | |
|---|---|---|---|---|---|---|---|---|---|---|---|---|---|---|---|---|---|
| Slab no. | B | C | H | N | P | S | V | Al | Ca | Cr | Cu | Mn | Mo | Nb | Ni | Si | Ti |
| E002 | 0.0002 | 0.04 | 1.9 | 0.0044 | 0.007 | 0.0005 | 0.008 | 0.029 | 0.0022 | 0.216 | 0.256 | 1.54 | 0.014 | 0.031 | 0.155 | 0.406 | 0.015 |
| C002 | 0.0001 | 0.037 | 1.9 | 0.0042 | 0.007 | 0.0002 | 0.008 | 0.031 | 0.0023 | 0.215 | 0.256 | 1.54 | 0.014 | 0.031 | 0.154 | 0.403 | 0.015 |

TABLE 2-1

| Summary of thickness, FRT, and CR reduction ratio of the tested plates | | | |
|---|---|---|---|
| Slab no. | Thickness (mm) | FRT (° C.) | CR reduction ratio |
| 55106261 | 25 | 820 | 1.8 |
| 55106262 | 25 | 820 | 1.8 |
| 55106331 | 25 | 800 | 3.0 |
| 55106031 | 41 | 820 | 1.8 |
| 55106032 | 41 | 820 | 1.8 |
| 55106012 | 41 | 800 | 2.5 |
| 55106049 | 41 | 850 | 3.0 |
| E002-1 | 41 | 838 | 3.0 |
| C002-1 | 41 | 798 | 1.8 |
| C002-2 | 41 | 111 | 2.5 |

Tensile Properties

Figure 7:
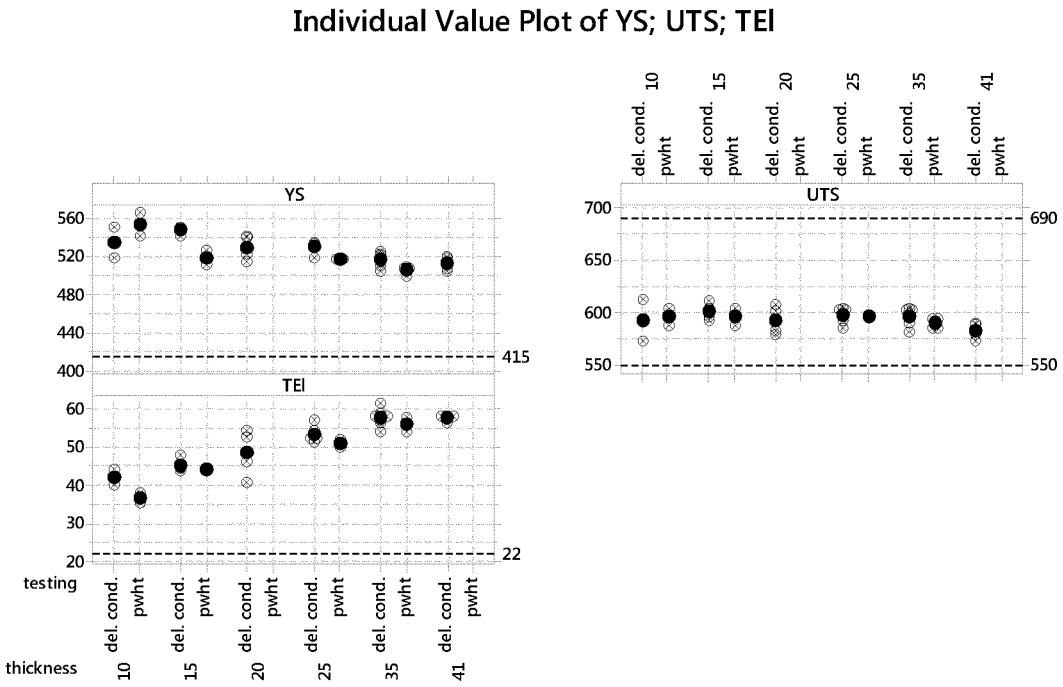
FIG. 7 is a graph showing the mechanical properties (YS, UTS, TEL) of plates with different thicknesses in delivery or PWHT condition.

Tensile properties were determined according ASTM E8 using transverse, 40 mm-wide and rectangular-shaped specimens. FIG. 7 shows that all the tested plates with thickness from 10 mm to 41 mm have yield strength above 480 MPa and ultimate tensile strength above 550 MPa in the delivery condition (del. cond.). The delivery condition is defined as the TMCP-ACC-T condition without any further treatment after the steps of accelerated continuous cooling (ACC) and tempering (T) in the thermomechanically controlled processing (TMCP) for producing the test plates of Example 2. Post weld heat treatment (PWHT) at 600° C. for 4 hours has very little effects on the tensile properties (FIG. 7).

Figure 8:
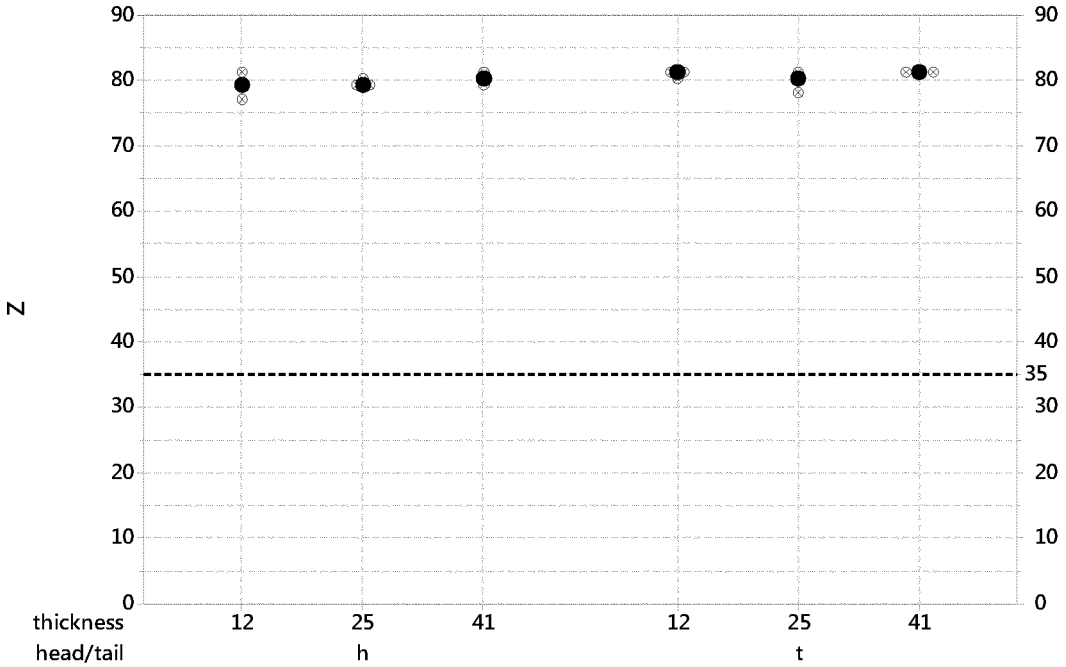
FIG. 8 is a graph showing the through-thickness tensile test results of plates with thicknesses of 12 mm, 25 mm and 41 mm.

Through-thickness tensile testing was performed on plates with thickness of 12 mm, 25 mm or 41 mm. A greater percentage reduction in cross-section before failure reflects greater ductility of the steel in the Z direction. FIG. 8 shows that the percentage reductions in cross-sectional area are from 77.6% to 81.8% which are much greater than 35% as required for the standard grade ASTM A537 CL2.

Charpy-V Impact Toughness

Figure 9:
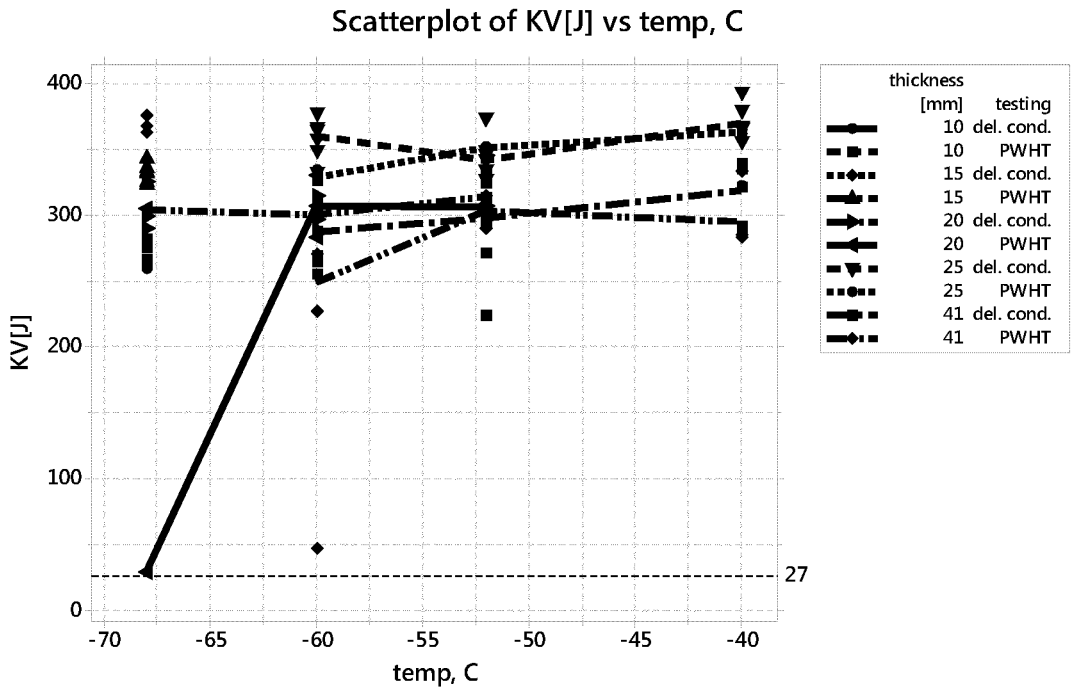
FIG. 9 is a graph showing the impact toughness level of plates with different thicknesses.

Impact toughness was determined in accordance with ASTM E23 using 7.5 mm×10 mm longitudinal plates with thickness of 10 mm, and 10 mm×10 mm longitudinal plates with thickness of 15 mm, 20 mm, 25 mm or 41 mm. The Charpy-V impact toughness varies for plates of different thicknesses as shown in FIG. 9. The Charpy-V impact toughness results of plates with different thicknesses in the longitudinal direction are summarized in Table 2-2.

TABLE 2-2

| Charpy-V impact toughness of plates with different thicknesses | | | |
|---|---|---|---|
| Thickness (mm) | KV (J/cm2) | Temp. (° C.) | Direction |
| 10 | >300 | −68 | Longitudinal |
| 15 | 375 | −68 | Longitudinal |
| 20 | 300 | −60 | Longitudinal |

TABLE 2-2-continued

| Charpy-V impact toughness of plates with different thicknesses | | | |
|---|---|---|---|
| Thickness (mm) | KV (J/cm2) | Temp. (° C.) | Direction |
| 25 | 375 | −60 | Longitudinal |
| 41 | 320 | −52 | Longitudinal |

The impact toughness levels of the 10 mm- and 15 mm-thick plates are located in the upper shelf above 300 J/cm2 at −68° C. with an energy being 375 J/cm$^2$ for the 15 mm-thick plates in delivery condition. The impact toughness levels of the 20 mm- and 25 mm-thick plates in delivery or PWHT condition are 300 J/cm$^2$ and 375 J/cm$^2$ respectively at −60° C. The impact toughness level of the 41 mm is 320 J at −52° C.

Figure 10:
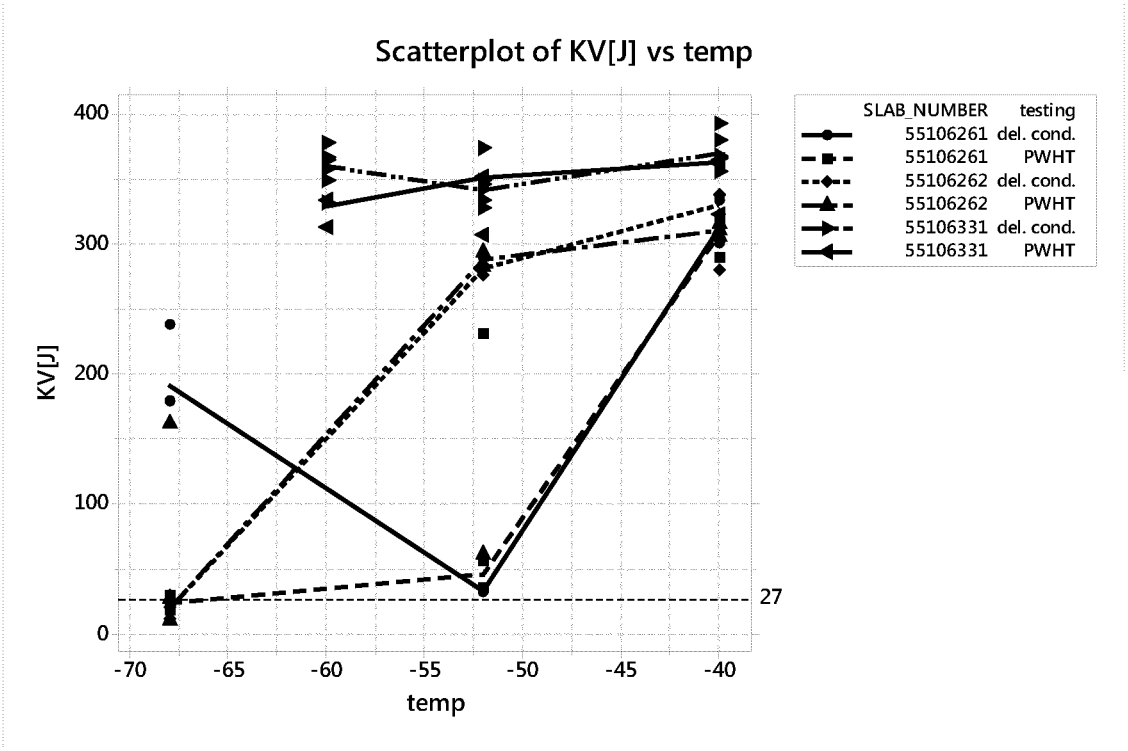
FIG. 10 is a graph showing the effect of rolling parameters on longitudinal Charpy-V impact toughness in plates with a thickness of 25 mm.
Figure 11:
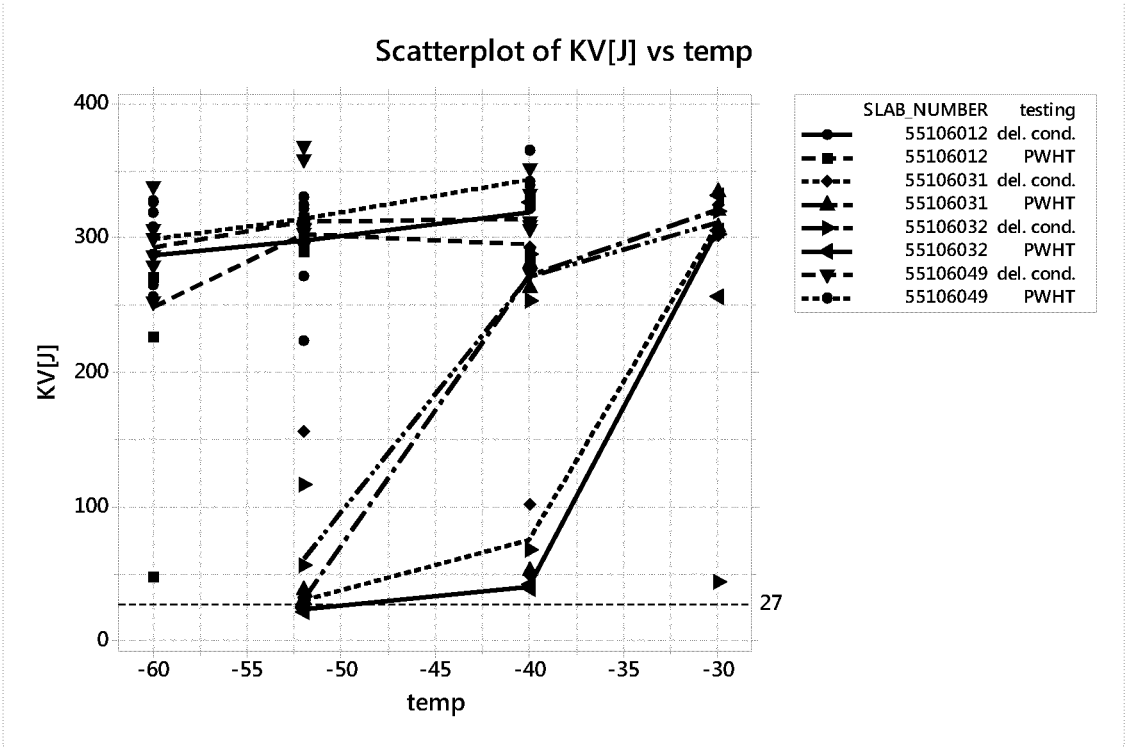
FIG. 11 is a graph showing the effect of rolling parameters on longitudinal Charpy-V impact toughness in plates with a thickness of 41 mm.

The effect of controlled rolling reduction on the impact toughness in 25 mm- and 41 mm-thick plates (Table 2-1) are shown in FIG. 10 and FIG. 11 respectively. FIG. 10 shows that raising the controlled rolling reduction ratio from 1.8 to 3 in 25 mm-thick plates lowers the transition temperature from −52° C. to −60° C. In the 41 mm-thick plates, raising the controlled rolling reduction ratio from 1.8 to 2.5 lowers the transition temperature from −40° C. to −60° C. (FIG. 11). The best results can be achieved when the controlled rolling reduction ratio is 3.0 (FIGS. 10 and 11).

PWHT-Resistance

Post weld heat treatment (PWHT) at 600° C. for 4 hours has very little effects on the tensile properties such as yield strength, ultimate tensile strength and elongation (FIG. 7) or the Charpy-V impact toughness results (FIGS. 9 to 11).

Bendability

Bendability was measured using a method as described in Example 1. The 41 mm-thick plate has a minimum bending radius 0.49 times plate thickness (Ri=0.49 t) in both longitudinal and transverse directions.

Microstructure

Microstructure was characterized using a method as described in Example 1. The microstructure of the steel with a thickness of 41 mm (Table 2-1) comprises quasi-polygonal ferrite, polygonal ferrite and bainite as visualized in FIG. 12.

The level of controlled rolling (CR) reduction and the final rolling temperature (FRT) have impacts on the grain size. The desired microstructure of E002-1 as shown in FIG. 9(*a*) is obtained by a combination of a controlled rolling reduction ratio of 3.0 and a final rolling temperature of 838° C. Higher controlled rolling reduction ratio generates more initiation sites for ferrite grains thereby reducing grain size. When the final rolling temperature applied is below 800° C., such as 798° C. in the case of C002-1 [FIG. 9(*b*)] or 777° C. in the case of C002-2 [FIG. 9(*c*)], the grain size is larger than when the final rolling temperature applied is above 800° C. [FIG. 9(*a*)].

Example 3

The chemical compositions used for producing the tested plates are presented in Table 3. The slab number C003 is the comparative example.

The tested plate is prepared by a process as described in Example 1.

A summary of the cooling parameters of the tested plates is presented in Table 3-1. The accelerated continuous cooling stop temperature has little or no effect on the mechanical properties (Table 3-2). However, the accelerated continuous cooling stop temperature is an important parameter determining the low-temperature toughness (Table 3-3).

Rolling trials with interrupted accelerated cooling were performed on the 41 mm-thick plates, which demonstrate that accelerated continuous cooling to a temperature below 230° C. is important for the low-temperature toughness. When the accelerated cooling was interrupted at a temperature in the range of 250° C. and 290° C. (Table 3-1), the Charpy-V impact toughness was drastically deteriorated at the temperature of −60° C. (Table 3-3).

TABLE 3

Chemical composition (wt. %) of the tested plates

| Slab no. | B | C | H | N | P | S | V | Al | Ca | Cr | Cu | Mn | Mo | Nb | Ni | Si | Ti |
|---|---|---|---|---|---|---|---|---|---|---|---|---|---|---|---|---|---|
| E003 | 0.0002 | 0.036 | 2.2 | 0.005 | 0.007 | 0.0004 | 0.01 | 0.036 | 0.0024 | 0.203 | 0.224 | 1.560 | 0.009 | 0.032 | 0.146 | 0.400 | 0.016 |
| C003 | 0.0001 | 0.036 | 1.9 | 0.0040 | 0.005 | 0.0000 | 0.008 | 0.033 | 0.0020 | 0.213 | 0.224 | 1.540 | 0.022 | 0.032 | 0.144 | 0.408 | 0.016 |

TABLE 3-1

Cooling parameters of the tested plates

| Slab no. | Thickness (mm) | Cooling start temp. (° C.) | Cooling finish temp. (° C.) |
|---|---|---|---|
| E003 | 41 | 790 | 50 |
| C003 | 41 | 850 | 250-290 |

TABLE 3-2

Mechanical properties of the tested plates

| Slab no. | Test no. | Thickness (mm) | K2 testing code | YS, $Rp_{0.2}$ | UTS, Rm | TEL, $A_{50}$ |
|---|---|---|---|---|---|---|
| E003 | 1 | 41 | A3 (plate head, round 12.5 mm specimen, transverse) | 514 | 593 | 31 |
| E003 | 2 | 41 | E3 (plate tail, round 12.5 mm specimen, transverse) | 512 | 593 | 32 |
| 0003 | 3 | 41 | A3 (plate head, round 12.5 mm specimen, transverse) | 517 | 596 | 30 |
| 0003 | 4 | 41 | E3 (plate tail, round 12.5 mm specimen, transverse) | 509 | 591 | 31 |

TABLE 3-3

Impact toughness properties of the tested plates

| Slab no. | Test no. | Thickness (mm) | K3 testing code | Temp. (° C.) | KV (J) |
|---|---|---|---|---|---|
| E003 | 1 | 41 | VA2 (plate head, ¼-thickness, transverse) | −60 | 455 |
| E003 | 2 | 41 | VB2 (plate tail, ¼-thickness, transverse) | −60 | 319 |
| E003 | 3 | 41 | JA2 (plate head, ¼-thickness, transverse, PWHT 600° C., 4 h) | −60 | 476 |
| E003 | 4 | 41 | JB2 (plate tail, ¼-thickness, transverse, PWHT 600° C., 4 h) | −60 | 369 |
| C003 | 5 | 41 | VA2 (plate head, ¼-thickness transverse), interrupted cooling to 300° C. | −60 | 23 |
| C003 | 6 | 41 | VA2 (plate head, ¼-thickness, transverse), interrupted cooling to 300° C. | −60 | 96 |
| C003 | 7 | 41 | VB2 (plate tail, ¼-thickness, transverse), interrupted cooling to 300° C. | −60 | 13 |
| C003 | 8 | 41 | VB2 (plate tail, ¼-thickness, transverse), interrupted cooling to 300° C. | −60 | 15 |
| C003 | 9 | 41 | JA2 (plate head, ¼-thickness, transverse, PWHT 600° C., 4 h), interrupted cooling to 300° C. | −60 | 172 |
| C003 | 10 | 41 | JB2 (plate tail, ¼-thickness, transverse, PWHT 600° C., 4 h), interrupted cooling to 300° C. | −60 | 15 |

The invention claimed is:

1. A high-strength steel product comprising a composition consisting of, in terms of weight percentages (wt. %):

C 0.02-0.05,
Si 0.1-0.6,
Mn 1.1-2.0,
Al 0.01-0.15,
Nb 0.01-0.08,
Cu ≤0.5,
Cr ≤0.5,
Ni ≤0.7,
Ti ≤0.03,
Mo ≤0.1,
V ≤0.1,
B ≤0.0005,
P ≤0.015,
S ≤0.005,
remainder Fe and inevitable impurities, wherein the high-strength steel product has
a microstructure comprising a matrix consisting of, in terms of volume percentages (vol. %):
quasi-polygonal ferrite 40-80,
polygonal ferrite 20-40,
bainite ≤20,
pearlite and martensite ≤20,
and the following mechanical properties:
a yield strength of at least 400 MPa,
an ultimate tensile strength of at least 500 MPa,
a Charpy-V impact toughness of at least 34 J/cm$^2$ at a temperature in a range of −50° C. to −100° C.

2. The high-strength steel product according to claim 1, wherein the high-strength steel product comprises non-metallic inclusions having an average inclusion size in a range of 1 μm to 4 μm in diameter, and wherein 95% of the inclusions are less than 4 μm in diameter.

3. The high-strength steel product according to claim 1, wherein the high-strength steel product is a strip or plate having a thickness in a range of 6 mm to 65 mm.

4. The high-strength steel product according to claim 1, wherein the high-strength steel product has a yield strength of at least 415 MPa.

5. The high-strength steel product according to claim 1, wherein the high-strength steel product has an ultimate tensile strength in a range of 500 MPa to 690 MPa.

6. The high-strength steel product according to claim 1, wherein the high-strength steel product has a minimum bending radius of 5.0 t or less in the longitudinal or transverse direction, and wherein t is the thickness of a steel strip or plate.

7. The high-strength steel product according to claim 1, wherein the high-strength steel product has been subjected to a post weld heat treatment at a temperature in a range of 500° C. to 680° C. for 1 hour to 8 hours.

8. A method for manufacturing the high-strength steel product according to claim 1 comprising the following steps of heating a steel slab with the composition according to claim 1 to a temperature in a range of 950° C. to 1350° C.;
hot rolling the heated steel slab in a plurality of hot rolling passes, wherein
i. the steel slab is subjected to a first plurality of rolling passes at a temperature above the austenite non-recrystallization temperature,
ii. the steel slab from step (i) is cooled down to a temperature below the austenite non-recrystallization temperature,
iii. the steel slab from step (ii) is subjected to a second plurality of controlled rolling passes at a temperature below the austenite non-recrystallization temperature, wherein the reduction ratio of the controlled rolling passes is at least 1.5, and wherein the final rolling temperature is in a range of 800° C. to 880° C.;
accelerated continuous cooling to a temperature below 230° C. at a cooling rate of at least 5° C./s; and
optionally, tempering at a temperature in a range of 580° C. to 650° C. for 0.5 hour to 1 hour.

9. The method according to claim 8, wherein the accumulative reduction ratio of hot rolling is in a range of 4.0 to 35.

10. The high-strength steel product according to claim 1, wherein the composition consists of, in terms of weight percentages (wt. %):

C 0.03-0.045,
Si 0.3-0.5,
Mn 1.35-1.8,
Al 0.02-0.06,
Nb 0.025-0.05,
Cu 0.15-0.35,
Cr 0.1-0.25,
Ni 0.1-0.25,
Ti 0.005-0.03,
Mo ≤0.1,
V ≤0.05,
B ≤0.0005,
P ≤0.012,
S ≤0.005,
remainder Fe and inevitable impurities.

11. The high-strength steel product according to claim 1, wherein the high-strength steel product has a Charpy-V impact toughness of at least 300 J/cm$^2$ at a temperature in a range of −50° C. to −100° C.

12. The high-strength steel product according to claim 1, wherein the high-strength steel product is a strip or plate having a thickness in a range of 10 mm to 45 mm.

13. The high-strength steel product according to claim 1, wherein the high-strength steel product has a yield strength in a range of 415 MPa to 650 MPa.

14. The high-strength steel product according to claim 1, wherein the high-strength steel product has a minimum bending radius of 0.5 t or less in the longitudinal or transverse direction, and wherein t is the thickness of a steel strip or plate.

15. The high-strength steel product according to claim 1, wherein the high-strength steel product has an ultimate tensile strength in a range of 550 MPa to 690 MPa.

16. The high-strength steel product according to claim 1, wherein the high-strength steel product has been subjected to a post weld heat treatment at a temperature in a range of 600° C. to 640° C. for 4 hour to 8 hours.

* * * * *